US011785366B2

(12) United States Patent
Proni et al.

(10) Patent No.: US 11,785,366 B2
(45) Date of Patent: Oct. 10, 2023

(54) MAGNETIC LOUDSPEAKER GRILL MOUNTING SYSTEM

(71) Applicant: JL AUDIO, INC., Miramar, FL (US)

(72) Inventors: Lucio Proni, Weston, FL (US); Dwayne Spanbroek, Boca Raton, FL (US); Kaushik Korat, Charlotte, NC (US)

(73) Assignee: JL Audio, Inc., Miramar, FL (US)

( * ) Notice: Subject to any disclaimer, the term of this patent is extended or adjusted under 35 U.S.C. 154(b) by 106 days.

(21) Appl. No.: 17/487,308

(22) Filed: Sep. 28, 2021

(65) Prior Publication Data

US 2022/0103918 A1 Mar. 31, 2022

Related U.S. Application Data

(60) Provisional application No. 63/084,727, filed on Sep. 29, 2020.

(51) Int. Cl.
*H04R 1/02* (2006.01)
*H01F 7/02* (2006.01)

(52) U.S. Cl.
CPC ..... *H04R 1/023* (2013.01); *H01F 7/02* (2013.01)

(58) Field of Classification Search
CPC ..... H04R 1/023
See application file for complete search history.

(56) References Cited

U.S. PATENT DOCUMENTS

| | | | | |
|---|---|---|---|---|
| 10,633,783 | B1 * | 4/2020 | Kelley | D06F 58/20 |
| 2006/0177088 | A1 * | 8/2006 | Howard | H04R 1/025 381/391 |
| 2008/0044053 | A1 * | 2/2008 | Belanger | H04R 1/023 381/386 |
| 2010/0040251 | A1 * | 2/2010 | Schreiber | H04R 1/08 381/361 |

* cited by examiner

*Primary Examiner* — Kile O Blair
(74) *Attorney, Agent, or Firm* — Christopher & Weisberg, P.A.

(57) ABSTRACT

An audio device includes a frame having a first frame portion having a first circumference and a second frame portion coupled to the first frame portion. A grill tray has a second circumference smaller than the first circumference and is coupled to the first frame portion. The first circumference of the frame and the second circumference of the grill tray define a grill slot therebetween. The audio device further includes a magnet partially protruding within the grill slot.

20 Claims, 5 Drawing Sheets

MAGNETIC LOUDSPEAKER GRILL MOUNTING SYSTEM

CROSS-REFERENCE TO RELATED APPLICATION

This application claims priority to and is related to U.S. Provisional Application Ser. No. 63/084,727, filed Sep. 29, 2020, entitled "MAGNETIC LOUDSPEAKER GRILL MOUNTING SYSTEM," the entirety of which is incorporated herein by reference.

FIELD

The present technology is generally related to speaker grill mounting systems for audio devices, and more particularly, magnetic speaker grill mounting systems for loudspeakers.

BACKGROUND

Audio devices, such as loudspeakers, generally include a grill to protect the speaker components from damage. A grill is typically mounted to or formed as a part an enclosure or baffle. Grills may include a screen formed of "soft" material such as fabric, or "hard" material" such as metal or wood, and may be attached directly to a frame of the speaker, to an enclosure that houses the speaker, or to a baffle that mounts the speaker.

Known speaker designs of the type described above do not permit customization of the appearance of the speaker or grill, e.g. variation of the color or configuration. Further, in outdoor applications such as on patios or boats, typical speaker grills are not easily replaceable should they sustain damage or become weathered in appearance. When replacing the grill of existing speakers, users generally require tools to mechanically separate the grill from the speaker. For some users, this may be a difficult and burdensome task when needing to replace the speaker grill.

Further, when mounted to the frame of the speaker, the grill often rattles, buzzes, or makes unwanted noise due to the speaker's acoustical output when in use, or from external vibrations (such as when being mounted or transported in an automobile or watercraft) due to the grill being in physical contact with the speaker frame or housing. Unwanted noise caused by the grill is often a nuisance to listeners that lessens the listener's enjoyment and overall experience when using the speaker.

SUMMARY

The techniques of this disclosure generally relate to a speaker grill mounting system for use with an audio device constructed in accordance with the principles of the present application.

In one embodiment, an audio device includes a frame having a first circumference, a grill tray having a second circumference smaller than the first circumference and coupled to the frame, and a magnet. The first circumference of the frame and the second circumference of the grill tray define a grill slot therebetween. The magnet partially protrudes within the grill slot.

In another aspect of this embodiment, the magnet is formed as a unitary structure with the grill tray.

In another aspect of this embodiment, a grill is sized and configured to be in direct contact with only the magnet and is partially received within the grill slot.

In another aspect of this embodiment, the grill includes a perforated screen composed of metal, and a perimeter of the perforated screen is received within the grill slot when the grill is in direct contact with the magnet.

In another aspect of this embodiment, magnets are circumferentially spaced from one another within the grill tray.

In another aspect of this embodiment, the magnets radially align the grill within the grill slot.

In another aspect of this embodiment, the magnets include a vibration dampening material adhered thereto.

In another aspect of this embodiment, the vibration dampening material includes rubber.

In another aspect of this embodiment, the grill is at least partially formed of a material that is attracted to magnetic force.

In another aspect of this embodiment, the magnets are positioned relative to the grill slot such that the grill contacts the vibration dampening material of the magnets.

In another aspect of this embodiment, the grill tray and the grill slot are substantially circular.

In another aspect of this embodiment, the grill tray has a depth and the magnets have a height greater than the depth of the grill tray such that the magnet protrudes beyond the grill tray.

In yet another embodiment, a loudspeaker includes a frame, a grill tray coupled to the frame, a magnet within the grill tray, and a grill. The frame and the grill tray define a grill slot therebetween and the magnet partially protrudes within the grill slot. The grill is sized and configured to be in direct contact with the magnet and partially received within the grill slot.

In another aspect of this embodiment, the magnet includes a vibration dampening material adhered thereto.

In another aspect of this embodiment, the grill is at least partially formed of a material that is attracted to magnetic force.

In another aspect of this embodiment, the magnet is positioned relative to the grill slot such that the grill contacts the vibration dampening material of the magnet.

In another aspect of this embodiment, the loudspeaker further includes more than one magnet and the grill tray and the grill slot are substantially circular. The magnets are circumferentially spaced from one another within the grill tray.

In another aspect of this embodiment, the magnets radially align the grill within the grill slot.

In another aspect of this embodiment, the magnets are formed as a unitary structure with the grill tray.

In yet another embodiment, a loudspeaker includes a frame having a first frame portion and a second frame portion removably coupled to the first frame portion, a grill tray coupled to the frame, magnets forming a unitary structure with the grill tray and circumferentially spaced apart from one another within the grill tray, and a grill at least partially formed of a material that is attracted to magnetic force. The first frame portion has a first circumference, and the grill tray has a second circumference smaller than the first circumference of the first frame portion. The first circumference of the first frame portion and the second circumference of the grill tray define a grill slot therebetween. The magnets each include a vibration dampening material adhered thereto and partially protrude within the grill slot. The grill is sized and configured to be in direct contact with the vibration dampening material of each magnet and partially received within the grill slot. The magnets radially align the grill within the grill slot.

The details of one or more aspects of the disclosure are set forth in the accompanying drawings and the description below. Other features, objects, and advantages of the techniques described in this disclosure will be apparent from the description and drawings, and from the claims.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
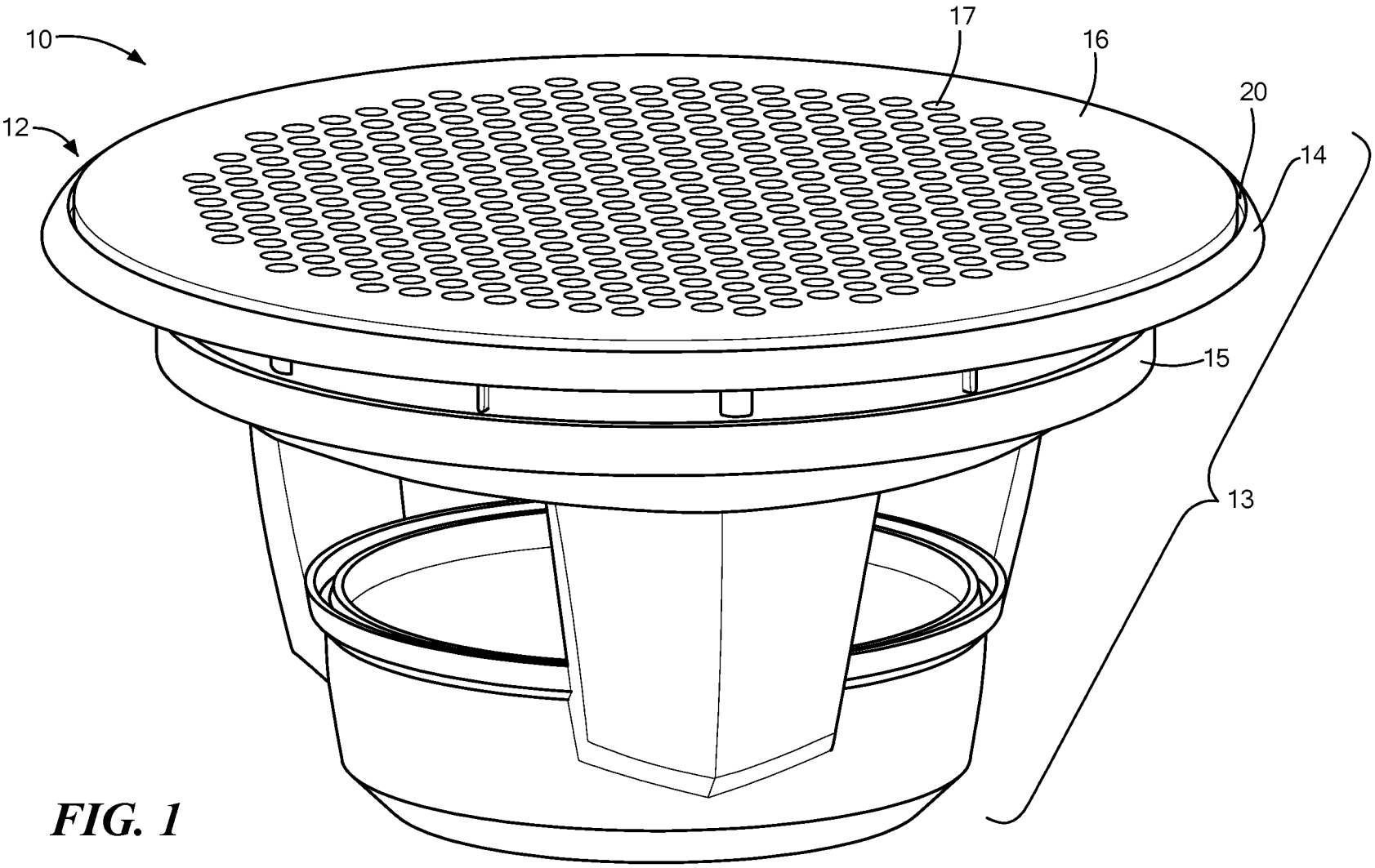
FIG. 1 shows a perspective view of an example audio device constructed in accordance with the principles of the present application.

Referring now to FIGS. 1-5, in which an exemplary speaker grill mounting system constructed in accordance with the principles of the present application and designated generally as "10" is shown. Like reference designators refer to like elements. As shown in FIG. 1, the system 10 may include an audio device 12 mountable on a ceiling, wall, roof, or other type of fixed or permanent structure, or configured to be a standalone speaker on a substantially flat or planar surface. In some configurations, the audio device 12 may be a loudspeaker 12 that includes a frame 13 having a first frame portion 14 and a second frame portion 15 coupled to the first frame portion 14, and a speaker grill 16 coupled to the first frame portion 14. In some embodiments, the first frame portion 14 and the second frame portion 15 may be formed as a unitary structure. However, in other embodiments, the second frame portion 15 may be removably coupled to the first frame portion 14 and vice-versa.

Figure 2:
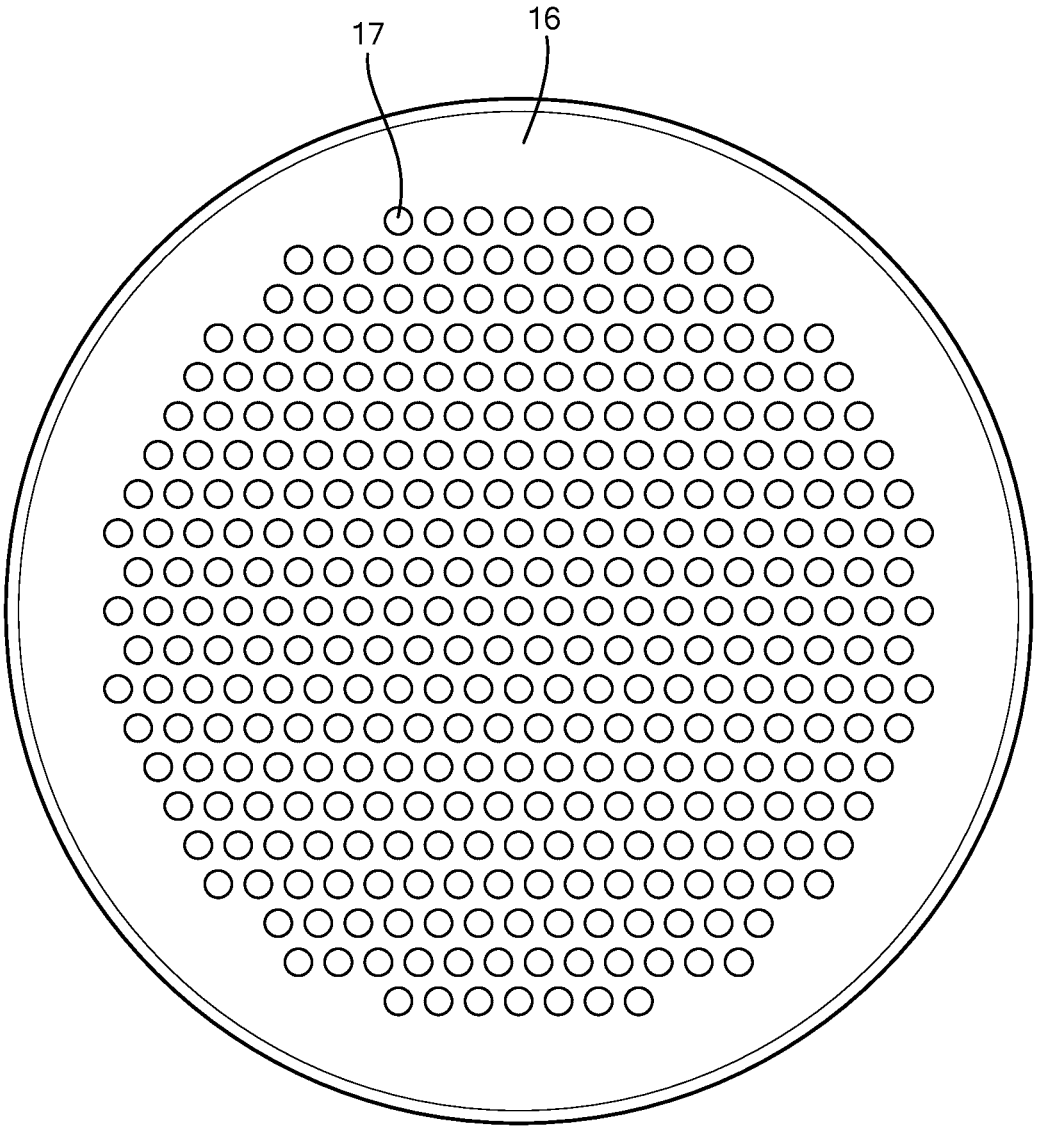
FIG. 2 shows a top view of the audio device of FIG. 1.

Referring now to FIG. 2, the speaker grill 16 includes a grate, mesh, or screen 17 that is composed of a metal, such as steel, that is attracted to magnetic force, and in some configurations, is perforated or porous. The perforations of the speaker grill 16 allow acoustical output to permeate the screen 17 so that the generated sound by the loudspeaker 12 is not dampened, muffled, or otherwise diminished in quality by the speaker grill 16. In one example configuration, the speaker grill 16 includes a perforated screen 17 (as shown in FIGS. 1-2). Additionally, in some configurations, the screen 17 may be composed of a fabric material that is woven or interleaved with the metal material so that the speaker grill 16 may still be attracted to magnetic force even when the grill 16 partially includes fabric or other non-metal materials. As shown in FIGS. 1-2, the speaker grill 16 does not include a separate outer rim that circumscribes the circumference, outer diameter, or perimeter of the perforated screen 17, and therefore, the perimeter of the perforated screen 17 may be referred to as the perimeter of the speaker grill 16. Although not shown in FIGS. 1-2, it is to be understood that in example configurations the perforations or pores defined by the screen 17 may extend all the way to the outer perimeter of the screen 17. In other words, the screen 17 may define perforations or pores throughout its entirety. However, in other embodiments, the speaker grill 16 may include a separate rim, ring, or flange that is coupled to and surrounds the perimeter of the perforated screen 17. In some such embodiments, the rim may be formed of, or include, a material that is attracted to magnetic force to facilitate the landing, mounting, coupling, or adhesion of the speaker grill 16 to the loudspeaker 12.

Figure 3:
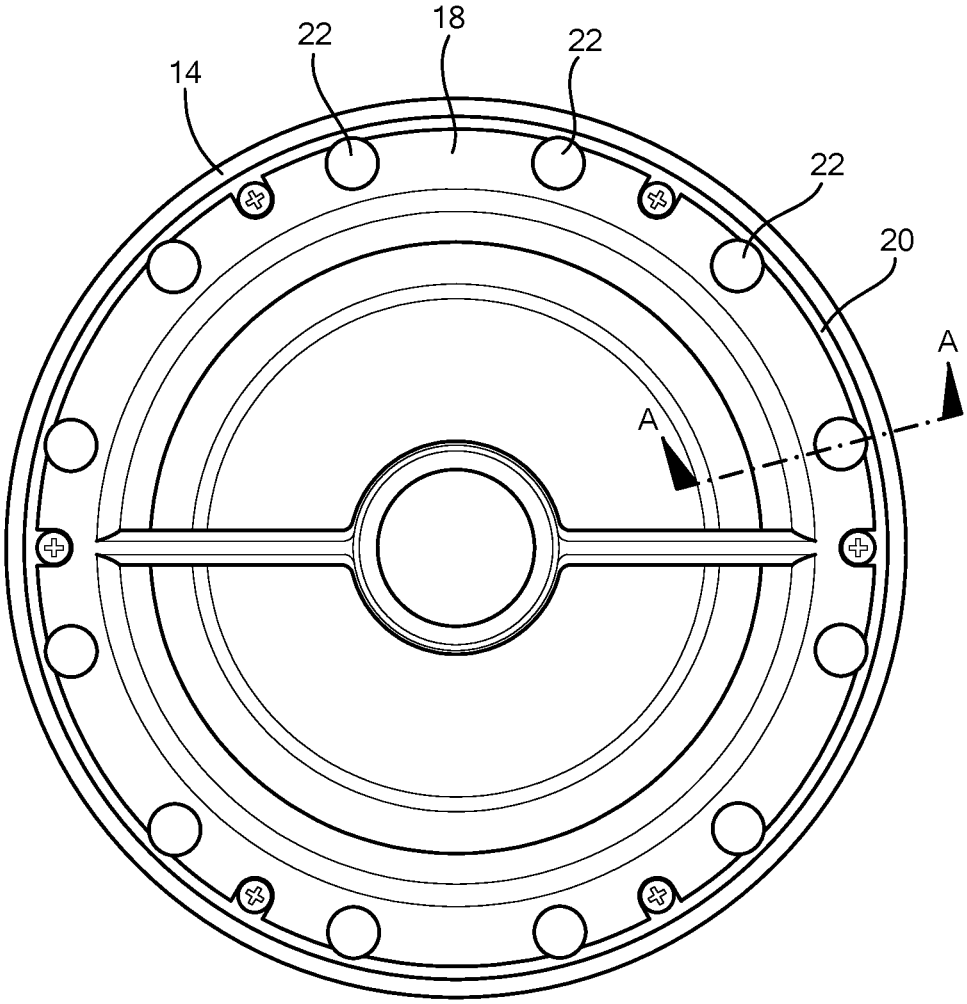
FIG. 3 shows a top view of the audio device of FIGS. 1-2, shown without a speaker grill.
Figure 4:
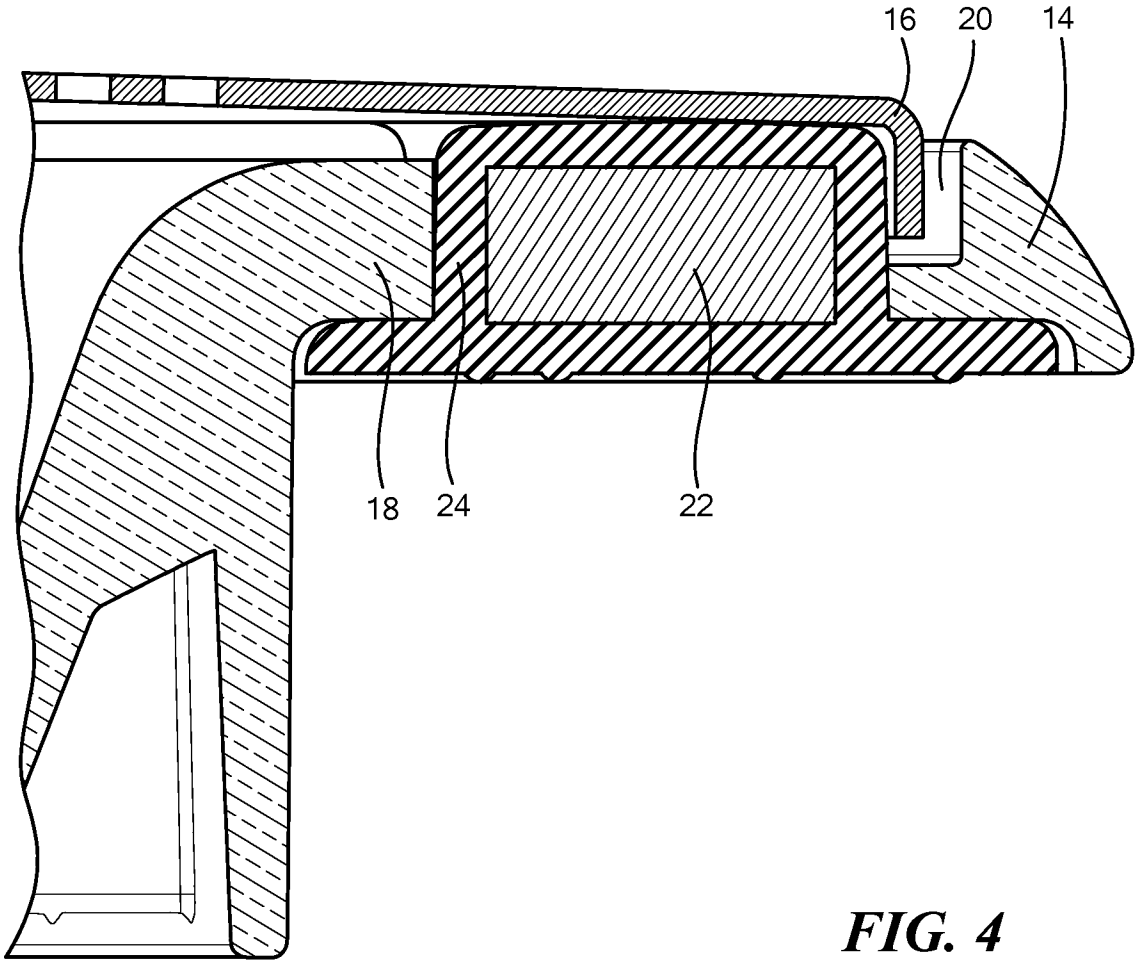
FIG. 4 shows the cross-section A-A of FIG. 3.

Referring now to FIG. 3, the loudspeaker 12 further includes a grill tray 18 coupled to the first frame portion 14. The first frame portion 14 has a first circumference and the grill tray 18 has a second circumference smaller than the first circumference such that the first and second circumferences of the first frame portion 14 and grill tray 18 define a channel or slot 20 therebetween that is sized and configured to receive at least a portion of the speaker grill 16. As such, the slot 20 may be referred to herein as a grill slot 20. In some configurations, the first frame portion 14 and grill tray 18 may each be substantially circular in shape. However, in other configurations, the first frame portion 14 and/or grill tray 18 may be ovular, square, triangular, rectangular, hexagonal, or may have any other geometric shape that would allow the circumferences or perimeters of the first frame portion 14 and grill tray 18 to define the grill slot 20. As shown in FIG. 3, the grill tray 18 includes at least one magnet 22 disposed therein. In some embodiments, the magnet 22 may be formed as, or form, a unitary structure with the grill tray 18, through overmolding or other similar manufacturing techniques, to eliminate gaps between the grill tray 18 and magnet 22 which may lead to rattling or buzzing during use of the loudspeaker 12. As described herein, use of the loudspeaker 12 refers to the generation and delivery of acoustical output that causes the speaker grill 16 to vibrate. Additionally, as discussed in more detail below, the grill tray 18 and/or magnet 22 may be coated with, encapsulated in, or otherwise adhered to a material having properties sufficient to dampen vibration of other parts or components of the loudspeaker 12 that may be in direct physical contact with either the grill tray 18 or magnet 22. In other words, each magnet 22 may include vibration dampening material 24 (as shown in FIG. 4). Additionally and/or alternatively, in other embodiments, the magnet 22 may not be formed as a unitary structure with the grill tray 18. For example, the grill tray 18 may instead define at least one socket, bore, opening, or aperture, sized and configured to receive and/or retain the magnet 22. The grill tray 18 may be formed or composed of the same vibration dampening material 24 as the magnet 22, or the grill tray 18 may be formed or composed of a material that is different than the vibration dampening material 24 of the magnet 22. The bore defined within the grill tray 18 has a depth that is less than the height or thickness of the magnet 22 so that at least a portion of the magnet 22 extends above the grill tray 18. Further, bore may not fully circumscribe the circumference of the magnet 22, thus allowing at least a portion of the magnet 22 to extend or protrude within the grill slot 20.

Figure 5:
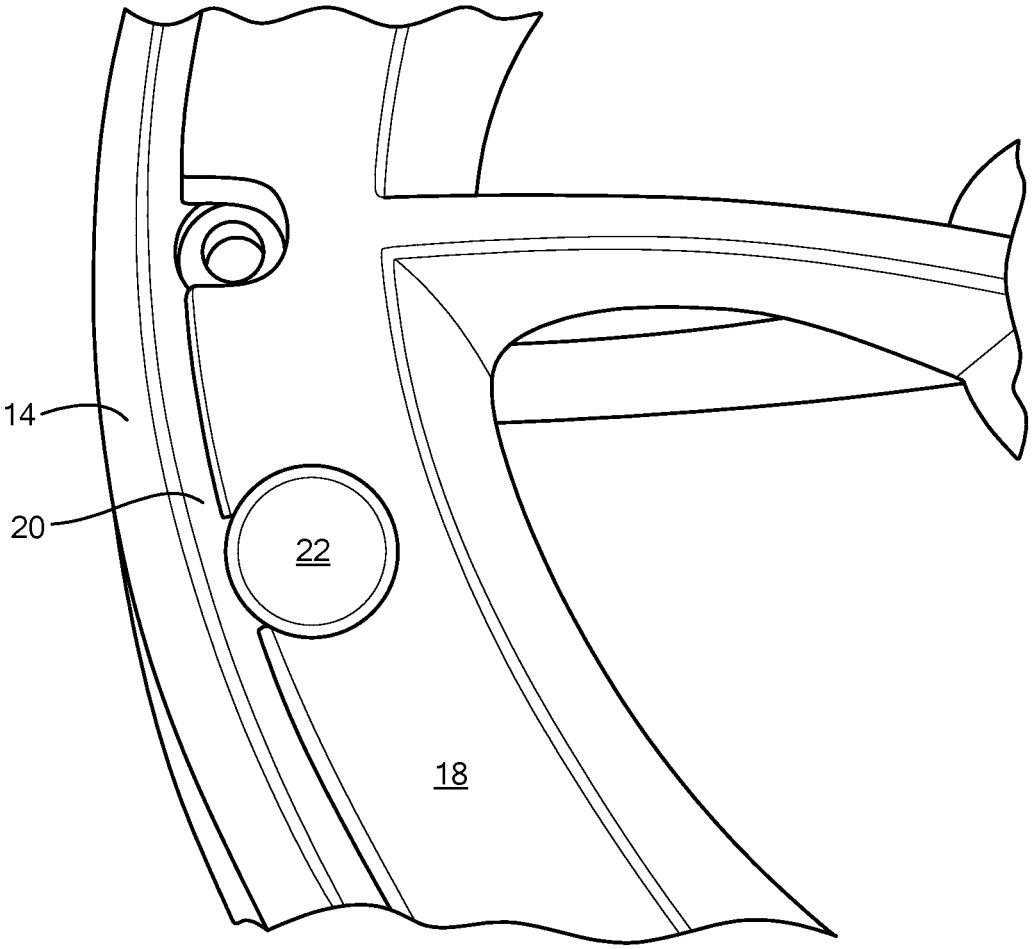
FIG. 5 shows a magnet protruding within a grill slot of the audio device of FIGS. 1-4.

Now referring to FIGS. 3-5, the grill tray 18 may include more than one magnet 22 circumferentially spaced from one another within the grill tray 18. The magnets 22 are capable of generating magnetic force to attract the speaker grill 16 to the loudspeaker 12. Each magnet 22 may have a height greater than a depth of the grill tray 18. Thus, each magnet 22 may protrude outwards and distally away from the grill tray 18. In other words, the magnets 22 may each define a raised surface with respect to the grill tray 18. Additionally, as shown in FIG. 3, at least a portion of each magnet 22 may partially protrude or extend within the grill slot 20 to act a magnetic landing point for the speaker grill 16 that prevents the speaker grill 16 from being in direct contact with the grill tray 18 or first frame portion 14. In other words, when the perimeter of the speaker grill 16 is received within the grill slot 20, the speaker grill 16 is only in direct contact with the magnets 22, including the vibration dampening material 24 of the magnets 22 (for example, as shown in FIG. 4). When in contact with the speaker grill 16, the vibration dampening material 24 of each magnet 22 reduces, dampens, limits, or otherwise eliminates unwanted or excessive vibration, buzzing, rattling, or shaking of the speaker grill 16 during use of the loudspeaker 12. In some example configurations, the vibration dampening material 24 includes rubber. However, in other configurations, the vibration dampening material 24 may include at least one soft and/or flexible material such as silicone, nitrile, vinyl, neoprene, polyurethane, fabric, or the like. Further, as shown in FIG. 4, the outer diameter or perimeter of the speaker grill 16 may be radially aligned within in the grill slot 20 by only the magnets 22, or an outer diameter or perimeter of the magnets 22. Although not described in detail herein, it is to be understood that each magnet 22 may have a rounded or substantially circular shape, however, in some configurations, each magnet 22 may instead have a different shape such as ovular, squared, rectangular, triangular, etc. Additionally, each magnet 22 may have the same or a different shape than any other magnet. In other words, the magnets 22 described herein are not limited to any particular shape or geometric configuration.

Further in one embodiment, not shown, the loudspeaker 12 may include a single magnet 22 coupled to the grill tray 18. The single magnet 22 may have a third circumference substantially similar to or larger than the second circumference of the grill tray 18. In this embodiment, the entire circumference of the single magnet 22 protrudes within the grill slot 20 around the entire circumference of the grill tray 18. In one example embodiment, the single magnet 22 is a ring-shaped magnet that is concentrically coupled to the grill tray 18 and partially extends within the grill slot 20.

Additionally, because the speaker grill 16 is magnetically attracted to the loudspeaker 12 by the magnetic force generated by the magnets 22, users may readily substitute the speaker grill 16 for other similarly sized and configured speaker grills to further customize the loudspeaker 12. This may be desirable if the speaker grill 16 becomes damaged or weathered in appearance, and needs to be replaced, or if the user wishes to further personalize the appearance of the loudspeaker 12. The system 10 described herein does not require the use of tools to mount the speaker grill 16 to the loudspeaker 12, and therefore, provides a more user friendly way to replace or install the speaker grill 16.

It should be understood that various aspects disclosed herein may be combined in different combinations than the combinations specifically presented in the description and accompanying drawings. It should also be understood that, depending on the example, certain acts or events of any of the processes or methods described herein may be performed in a different sequence, may be added, merged, or left out altogether (e.g., all described acts or events may not be necessary to carry out the techniques).

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. An audio device, comprising:

a frame having a first circumference;

a grill tray having a second circumference smaller than the first circumference and coupled to the frame;

the first circumference of the frame and the second circumference of the grill tray defining a grill slot therebetween; and a magnet within the grill tray and partially protruding within the grill slot.

2. The device of claim 1, wherein the magnet is formed as a unitary structure with the grill tray.

3. The device of claim 1, further including a grill sized and configured to be in direct contact with only the magnet and is partially received within the grill slot.

4. The device of claim 3, wherein:

the grill includes a perforated screen composed of metal; and a perimeter of the perforated screen is received within the grill slot when the grill is in direct contact with the magnet.

5. The device of claim 3, further including a plurality of magnets circumferentially spaced from one another within the grill tray.

6. The device of claim 5, wherein the plurality of magnets radially align the grill within the grill slot.

7. The device of claim 3, wherein the magnet includes a vibration dampening material adhered thereto.

8. The device of claim 7, wherein the vibration dampening material includes rubber.

9. The device of claim 7, wherein the grill is at least partially formed of a material that is attracted to magnetic force.

10. The device of claim 9, wherein the magnet is positioned relative to the grill slot such that the grill contacts the vibration dampening material of the magnet.

11. The device of claim 10, wherein the grill tray and the grill slot are substantially circular.

12. The device of claim 1, wherein the grill tray has a depth and the magnet has a height greater than the depth of the grill tray such that the magnet protrudes beyond the grill tray.

13. A loudspeaker, comprising:

a frame and a grill tray coupled to the frame;

the frame and the grill tray defining a grill slot therebetween;

a magnet within the grill tray and partially protruding within the grill slot; and a grill sized and configured to be in direct contact with the magnet and partially received within the grill slot.

14. The loudspeaker of claim 13, wherein the magnet includes a vibration dampening material adhered thereto.

15. The loudspeaker of claim 14, wherein the grill is at least partially formed of a material that is attracted to magnetic force.

16. The loudspeaker of claim 15, wherein the magnet is positioned relative to the grill slot such that the grill contacts the vibration dampening material of the magnet.

17. The loudspeaker of claim 16, further including a plurality of magnets and wherein the grill tray and the grill slot are substantially circular, the plurality of magnets being circumferentially spaced from one another within the grill tray.

18. The loudspeaker of claim 17, wherein the plurality of magnets radially align the grill within the grill slot.

19. The loudspeaker of claim 18, wherein the plurality of magnets are formed as a unitary structure with the grill tray.

20. A loudspeaker, comprising:

a frame including:

a first frame portion having a first circumference; and a second frame portion removably coupled to the first frame portion;

a grill tray coupled to the first frame portion and having a second circumference smaller than the first circumference of the first frame portion;

the first circumference of the first frame portion and the second circumference of the grill tray defining a grill slot therebetween;

a plurality of magnets formed as a unitary structure with the grill tray and circumferentially spaced apart from one another within the grill tray, the plurality of magnets each including a vibration dampening material adhered thereto and partially protrude within the grill slot; and a grill at least partially formed of a material that is attracted to magnetic force sized and configured to be in direct contact with the vibration dampening material of each magnet and partially received within the grill slot, the plurality of magnets radially aligning the grill within the grill slot.

* * * * *